US006653582B2

(12) United States Patent
Kasakawa et al.

(10) Patent No.: US 6,653,582 B2
(45) Date of Patent: Nov. 25, 2003

(54) STOP LAMP SWITCH AND METHOD FOR ATTACHING THE SAME

(75) Inventors: Noriyuki Kasakawa, Tsuruga (JP); Masahiro Hirobe, Nagahama (JP); Koji Jahara, Higashihiroshima (JP); Kenji Nakatani, Higashihiroshima (JP); Takayoshi Nishijima, Hiroshima (JP); Hiroshi Miyazaki, Hiroshima (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/293,298

(22) Filed: Nov. 14, 2002

(65) Prior Publication Data

US 2003/0111328 A1 Jun. 19, 2003

(30) Foreign Application Priority Data

Nov. 15, 2001 (JP) ..... 2001-349813

(51) Int. Cl.[7] ..... H01H 3/14
(52) U.S. Cl. ..... 200/86.5; 200/243
(58) Field of Search ..... 200/86.5, 243, 200/244, 245–257, 286, 290, 239, 283, 16 R–16 D, 520, 541, 530–536

(56) References Cited

U.S. PATENT DOCUMENTS 2,526,061 A * 10/1950 Batchller ..... 200/532
2,636,092 A * 4/1953 Schneider ..... 200/61.29
3,171,914 A * 3/1965 Ohanian ..... 200/61.89
3,548,134 A * 12/1970 Harthan, Jr. ..... 200/86.5
3,781,501 A * 12/1973 Borghetti ..... 200/279
4,172,217 A * 10/1979 Miller ..... 200/86.5
4,215,254 A * 7/1980 Ohki ..... 200/83 C
4,421,959 A * 12/1983 Chen et al. ..... 200/16 A
4,454,497 A * 6/1984 Morse ..... 340/438
4,853,556 A * 8/1989 Pfalzgraf et al. ..... 307/10.1
4,894,652 A * 1/1990 Eckstein et al. ..... 340/467
6,326,570 B1 * 12/2001 Fujii et al. ..... 200/520

FOREIGN PATENT DOCUMENTS

FR 2652444 * 9/1989
JP 2012717 * 9/1988

* cited by examiner

*Primary Examiner*—Elvin Enad
*Assistant Examiner*—Lisa Klaus
(74) *Attorney, Agent, or Firm*—Greenblum & Bernstein, P.L.C.

(57) ABSTRACT

A stop lamp switch of the present invention includes; an operating shaft having one end face being outwardly projected from a switch case body, the end face abutting on a brake pedal of a vehicle; an actuator moving within the switch case body to separate a movable contact from a fixed contact; an engaging spring attached to the other end of the actuator so as to be engaged with a concave-convex locking portion provided on the operating shaft, and a spring regulating member for engaging both free ends of the engaging spring with engaging step portions provided to the spring regulating member in a freely engageable/disengageable manner while the engaging spring is being in a spread state.

4 Claims, 10 Drawing Sheets

STOP LAMP SWITCH AND METHOD FOR ATTACHING THE SAME

The present disclosure relates to subject matter contained in priority Japanese Patent Application No. 2001-349813, filed on Nov. 15, 2001, the contents of which is herein expressly incorporated by reference in its entirety.

BACKGROUND OF THE INVENTION

1. Field of the Invention

The present invention relates to a stop lamp switch which is used for controlling a stop lamp to be lighted only when a brake pedal of a vehicle is pressed and to a method for attaching such a stop lamp switch.

2. Description of Related Art

Recently, the following type of stop lamp switch has been widely used as a stop lamp switch employed for controlling the lighting of a stop lamp. Specifically, when the stop lamp switch is to be attached to an attachment bracket opposing to a brake pedal of a vehicle, a projected length of an operation shaft of the stop lamp switch can be adjusted while directly abutting the operating shaft on the brake pedal. Such a stop lamp switch is intended to ensure a turn-on operation of the stop lamp when the brake pedal is pressed and a turn-off operation of the stop lamp when the brake pedal is no more pressed, regardless of variations in size and shape of the stop lamp switch, its relative position with respect to the brake pedal or the attachment bracket, and the like.

The above-described type of a conventional stop lamp switch has a structure as shown in a longitudinal cross-sectional view of FIG. 9. More specifically, a cover body 3 is connected to a cylindrical case 2 made of an insulating resin with an upper open end, through the engagement between engagement holes 4 and engagement claws 7 to form a stop lamp switch 1. A connector connection part 2*b* for fitting a connector described below thereto is integrally formed with the case 2 below its bottom wall 2*a*. Terminal portions 8*a* of fixed contacts 8 are penetrated through the bottom wall 2*a* so as to be projected into the connector connection part 2*b*, whereby the fixed contacts 8 are held at predetermined positions within the case 2. Movable contacts 9, which constitute switch contacts with the fixed contacts 8, are in elastic contact with the fixed contacts 8 on their bottoms by a contact pressure spring 10 interposed between the movable contacts 9 and the bottom wall 2*a* in a somewhat deflected state.

A cylindrical actuator 11 serves to allow the movable contacts 9 to be in contact with/separate from the fixed contacts 8. The cylindrical actuator 11 is provided so as to be freely slidable in in/out directions to/from the case 2 by fitting a guide rib (not shown) of the actuator 11 into a guide groove (not shown) of the case 2. At the same time, the actuator 11 is always energized by a return spring 12 in such a direction that the actuator 11 is projected from the case 2. The return spring 12 is provided between an engagement wall 11*a* and the bottom wall 2*a* of the case 2, where the engagement wall 11*a* is integrally formed with the actuator 11 so as to divide an inner space of the actuator 11 in two. A cylindrical operating shaft 13 having a head is penetrated through a guide hole 3*a* of the cover body 3 so as to be connected to one end of the actuator 11 with an engaging spring 14 being interposed therebetween in a displaceable state. More specifically, the engaging spring 14 having an approximately U shape when viewed from a plane is engaged with one end of the actuator 11 so as to perpendicularly cross an opening on the end of the actuator 11. The operating shaft 13 has concave-convex locking portions 13*a* formed along its axial direction on parts of its outer surface, the parts of the outer surface being opposed to each other in a radial direction. The concave-convex locking portions 13*a* are forced into a slightly enlarged middle space of the U-shaped engaging spring 14 while spreading the middle space, so that the operating shaft 13 is connected to the actuator 11 with the engaging spring 14 being interposed therebetween.

The engaging spring 14 is brought into elastic contact with the concave-convex locking portions 13*a* on the both sides due to a restoring force of the middle portion of the engaging spring 14 which is deformed in a spreading direction. The operating shaft 13 can be forced into the actuator 11 against the engagement force of the engaging spring 14 with the concave-convex locking portions 13*a*. The operating shaft 13 is thus forced into the actuator 11 so as to adjust its projected length from the guide hole 3*a* of the cover body 3. As a result, a connected length between the actuator 11 and the operating shaft 13 can be adjusted in such a manner to allow the reduction thereof.

The stop lamp switch 1 is attached in the following manner. After a part of the operating shaft 13 and the cover body 3 is inserted into an attachment hole 17*a* of the attachment bracket 17 which is opposed to a brake pedal of a vehicle, the stop lamp switch 1 is relatively rotated with respect to the attachment bracket 17 so as to engage engaging portions 3*b* outwardly protruding from both sides of the cover body 3 in its radial direction with the edge of the attachment hole 17*a*. FIG. 10 is a side view showing a state where the stop lamp switch 1 is attached to the attachment bracket 17 of a vehicle in the above-described manner. A brake pedal 18 is freely turnably provided around a spindle 19 serving as a supporting point. At the same time, the brake pedal 18 is energized to be turned in a right-hand direction of FIG. 10 by a spring 20 so as to be held at a normal position indicated with a solid line in the drawing. More specifically, the spring 20 is set to have a larger spring pressure than the total spring pressure of the contact pressure spring 10 and the return spring 12 of the stop lamp switch 1.

The operating shaft 13 of the stop lamp switch 1 before its attachment is set to have a rather large projected length from the guide hole 3*a*. In its attachment to a vehicle, the operating shaft 13 is pushed into the cover body 3 until the projected length is reduced to allow the attachment of the operating shaft 13 to the attachment bracket 17 while a tip of the operating shaft 13 is abutting on an abutting face 21 of the brake pedal 18. At this moment, the engagement force between the concave-convex locking portions 13*a* of the operating shaft 13 and the engaging spring 14 is larger than the spring pressure of the spring 20. Consequently, in the case where the operating shaft 13 is inserted into the attachment hole 17*a* of the attachment bracket 17, the brake pedal. 18 is pressed by the operating shaft 13 so as to be turned from the position indicated with the solid line in FIG. 10 to the position indicated with a double-chain line against the energizing force of the spring 20. Accordingly, with such a structure, it is not possible to adjust a projected length by inserting the operating shaft 13 into the cover body 3.

In order to solve this problem, the stop lamp switch 1 has been conventionally attached in the following procedure. The operating shaft 13 is penetrated through the attachment hole 17*a* of the attachment bracket 17 so that its tip abuts on the abutting face 21 of the brake pedal 18 while holding the brake pedal 18 so as not to be moved from the normal position indicated with the solid line in FIG. 10. Thereafter, the stop lamp switch 1 is pushed toward the brake pedal 18.

In the above-described attachment operation, when the operating shaft 13 is pushed against the abutting face 21, the actuator 11, which holds the operating shaft 13 with the engaging spring 14 being interposed therebetween, moves in a downward direction in the drawing from the state shown in FIG. 9 while compressing the return spring 12. As a result, the movable contacts 9 are pushed down to be separated from the fixed contacts 8. Thereafter, once the actuator 11 abuts on the bottom wall 2*a* of the case 2 through the movable contacts 9, the actuator 11 is no more displaceable. Therefore, the operating shaft 13 is subsequently inserted into the actuator 11 while the concave-convex locking portions 13*a* are spreading the engaging spring 14 which is in elastic contact therewith. As a result, the engaging portions 3*b* of the cover body 3 are ready to fit into the attachment hole 17*a* of the attachment bracket 17. The stop lamp switch 1 is relatively rotated with respect to the attachment bracket 17 in this state so as to be fixed.

In this attachment state, the operating shaft 13 is connected to the actuator 11 at the adjusted relative position with respect to the actuator 11 through the engagement between the concave-convex locking portions 13*a* and the engaging spring 14. Moreover, the brake pedal 18 is held at the normal position indicated with the solid line shown in FIG. 10 by a larger energizing force of the spring 20 against the energizing force of the contact pressure spring 10 and the return spring 12. Therefore, the movable contacts 9 are held at the position separated from the fixed contacts 8 so that the switch contacts are kept in an OFF state. Then, as shown in FIG. 10, when a connector 22 is fitted to the connector connection part 2*b* of the case 2, the terminal portions 8*a* of the fixed contacts 8 are inserted to be connected to a power supply circuit of a stop lamp (not shown) through the connector 22, thereby completing the attachment of the stop lamp switch 1.

When the brake pedal 18 is pressed so as to be displaced to the position indicated with the double-chain line of FIG. 10, the abutting face 21 is separated from the operating shaft 13 so as to cancel the application of a pressure on the operating shaft 13. Thus, the actuator 11 moves while pushing out the operating shaft 13 outside the cover body 3 due to the energizing force of the return spring 12. At the same time, the movable contacts 9 are brought into elastic contact with the fixed contacts 8 due to the energizing force of the contact pressure spring 10, whereby the switch contacts are brought into an ON state. As a result, a power is supplied to a stop lamp via the stop lamp switch 1 in an ON state so as to light the stop lamp.

However, since a projected length of the operating shaft 13 is adjusted upon attachment of the operating shaft 13 to the attachment bracket 17 in the above-described stop lamp switch 1, at least two operators are required; one is for keeping the brake pedal 18 with his (her) hands to hold it at the normal position, and the other is for pushing the stop lamp switch 1 toward the abutting face 21 so as to push the operating shaft 13 into the cover body 3. What is worse, since the application of a considerably large pressure is required to press the operating shaft 13 into the actuator 11 against the engagement force between the concave-convex locking portions 13*a* of the shaft 13 and the engaging spring 14, an operation time period becomes disadvantageously long.

In order to allow the adjustment of a projected length of the operating shaft 13 to be effectuated by only one operator, the following attachment procedure of the stop lamp switch 1 has also been conventionally taken. After the operating shaft 13 is inserted into the attachment hole 17*a* of the attachment bracket 17, the brake pedal 18 is pressed by the operating shaft 13 to be turned from the position indicated with the solid line in FIG. 10 to the position indicated with the double-chain line. In this manner, the stop lamp switch 1 is first fixed onto the attachment bracket 17. Thereafter, the brake pedal 18 at the position indicated with the double-chain line is returned to the position indicated with the solid line so that the operating shaft 13 whose tip abuts on the abutting face 21 of the brake pedal 18 is forced into the actuator 11 against the engagement force between the concave-convex locking portions 13*a* and the engaging spring 14. In this attachment method, however, one operator is obliged to have a considerable physical burden. Furthermore, there is a possibility that the attachment operation might be terminated before the operating shaft 13 is fully pushed to the predetermined position, due to physical fatigue of the operator. In such a case, an inconvenience possibly occurs in that the stop lamp may not stably lighted for each pressing operation of the brake pedal 18.

SUMMARY OF THE INVENTION

In light of the above problems, the present invention has an object of providing a stop lamp switch having such a structure that allows its easy attachment to a vehicle by only one operator and an attachment method thereof for allowing efficient and precise attachment of the stop lamp switch to a vehicle.

In order to achieve the above object, a stop lamp switch according to the present invention includes: an operating shaft penetrating through a guide hole of a switch case body so as to be outwardly projected, an end of the operating shaft on an outer side abutting on a brake pedal of a vehicle; a cylindrical actuator freely movably provided within the switch case body, for separating a movable contact from a fixed contact when the cylindrical actuator moves toward its one end side along a core direction of its cylindrical body; an approximately U-shaped engaging spring attached to the other end of the actuator so as to move integrally with the actuator, the engaging spring being engaged with a concave-convex locking portion provided on the other end side of the operating shaft so as to connect the other end of the actuator to the operating shaft; and a spring regulating member for spreading the engaging spring so as to engage both free ends of the engaging spring with engaging step portions provided to the spring regulating member in a freely engageable/disengageable manner with a reduced engagement force to the concave-convex locking portion, so that a protruding working piece provided to the spring regulating member is slidably penetrated through a through hole of a bottom wall of the switch case body to be outwardly projected. The stop lamp switch is constituted such that, after the operating shaft is inserted into the actuator so as to adjust a projected length of the operating shaft from the guide hole, the protruding working piece is pushed into the switch case body to move the spring regulating member so as to disengage both the free ends from the engaging step portions, whereby the engaging spring is engaged with the concave-convex locking portion so that the operating shaft is connected to the actuator in an integrally movable manner.

In this stop lamp switch, the operating shaft is penetrated through, for example, an attachment hole of an attachment bracket of a vehicle so as to push a tip of the operating shaft against the brake pedal at a normal position. Then, since the concave-convex locking portions of the operating shaft and the engaging spring in a spread state are held in an engaged state by a small engagement force, the operating shaft is subjected to a reaction against a pressure applied on the brake pedal so as to be smoothly inserted into the actuator. In this manner, since the application of an extremely small force is sufficient to insert the operating shaft into the actuator, the brake pedal does not move from its normal position even if the brake pedal is not held at the normal position. After a projected length of the operating shaft is adjusted to an appropriate length in this manner to complete the attachment of the operating shaft to the attachment bracket, the protruding working piece outwardly protruding from the switch case body is inwardly pushed to move the spring regulating member. Then, a pair of the free ends of the engaging spring come out from the engaging step portions of the spring regulating member so as to cancel the spread state of the engaging spring. Therefore, the engaging spring is pressed against the concave-convex locking portions of the operating shaft by a restoring force generated by the cancellation of the spread state. As a result, the operating shaft is certainly connected to the actuator with a projected length being adjusted to be at a predetermined relative position with respect to the brake pedal.

In the above-described invention, it is preferred that: the switch case body be constituted by connecting a cylindrical case having an open end with a cover body covering the opening of the case; the actuator be provided within the case so as to be freely movable in a core direction of the cylindrical case; the operating shaft be penetrated through a guide hole of the cover body; a terminal plate of a fixed contact be penetrated through the bottom wall of the case so that a terminal portion is guided into a connector connection part of the case; and the spring regulating member include: a pair of clearance holes for allowing movement of both the free ends of the engaging spring upon integral movement of the operating shaft and the actuator in an outer direction along with separation of the brake pedal from the operating shaft caused by a pressing operation of the brake pedal; and the engaging step portions, each being formed on an edge of each of the clearance holes on its one end.

With this structure, when the connector is fitted to the connector connection part so as to be connected to the terminal portions, the protruding working piece is automatically pushed into the case by the connector in the fitting operation so as to move the spring regulating member, thereby canceling the spread state of the engaging spring. Therefore, since it is not necessary to separately conduct a pushing operation of the protruding working piece, the efficiency of the attachment operation is improved. Moreover, since both the tree ends of the engaging spring, whose engagement with the engaging step portions is cancelled, move within the clearance holes of the spring regulating member when the actuator moves in such a direction that the operating shaft is projected along with the pressing operation of the brake pedal, the contact/separation of the movable contacts to/from the fixed contacts can be performed without any inconvenience.

Moreover, in the above-described structure, it is preferred that: a contact pressure spring for energizing the movable contact toward the fixed contact be interposed between the movable contact and the bottom wall of the case, and a return spring for energizing the operating shaft in such a direction that the operating shaft is projected from the guide hole be provided between the operating shaft and the bottom wall; and the cover body have position regulating pieces respectively abutting on vicinities of both the free ends of the engaging spring so as to hold the actuator in a state where the movable contact is separated from the fixed contact due to movement of the actuator, each of the position regulating pieces being provided in a projected manner at a position allowing cancellation of abutment of the engaging spring simultaneously with disengagement of both the free ends of the engaging spring from engaging portions of the spring regulating member.

As a result, when the brake pedal is separated from the operating shaft by its pressing operation, the operating shaft is moved in a projected direction due to an energizing force of the return spring. At the same time, the actuator is subjected to an energizing force of the contact pressure spring through the movable contacts so as to be moved integrally with the operating shaft. As a result, the movable contacts are surely brought into contact with the fixed contacts by the energizing force of the contact pressure spring. Even with such a structure, before the attachment, the actuator and the operating shaft can be ensured to be held at predetermined positions against the energizing force of the contact pressure spring and the return spring owing to the position regulating pieces of the cover body. Moreover, a pushing operation of the protruding working piece into the case allows the pair of free ends to return in an approaching direction due to the cancellation of the spread state of the engaging spring so that the free ends automatically come out from the position regulating pieces. As a result, the operating shaft can arbitrarily move in in/out directions to/from the cover body.

A method for attaching a stop lamp switch of the present invention is characterized by the steps of: penetrating an operating shaft of the stop lamp switch according to the present invention through an attachment hole of an attachment bracket opposing to a brake pedal of a vehicle so that a tip of the operating shaft abuts on the brake pedal; pressing the stop lamp switch against the attachment bracket until an engaging portion of the operating shaft is penetrated through the attachment hole so as to push the other end of the operating shaft into the cylindrical actuator, thereby fixing the operating shaft to the attachment bracket; and simultaneously with fitting of a connector to a connector connection part of the stop lamp switch, pressing a protruding working piece of a spring regulating member with the connector so as to push the protruding working piece into the case.

In this method of attaching the stop lamp switch, when the connector is fitted to the connector connection part, the fitted connector pushes the protruding working piece into the case so as to automatically and simultaneously cancel the spread state of the engaging spring and the stopped movement of the actuator. As a result, the efficiency of the attachment operation is improved.

While novel features of the invention are set forth in the preceding, the invention, both as to organization and content, can be further understood and appreciated, along with other objects and features thereof, from the following detailed description and examples when taken in conjunction with the attached drawings.

DETAILED DESCRIPTION OF THE PREFERRED EMBODIMENTS

Figure 1A:
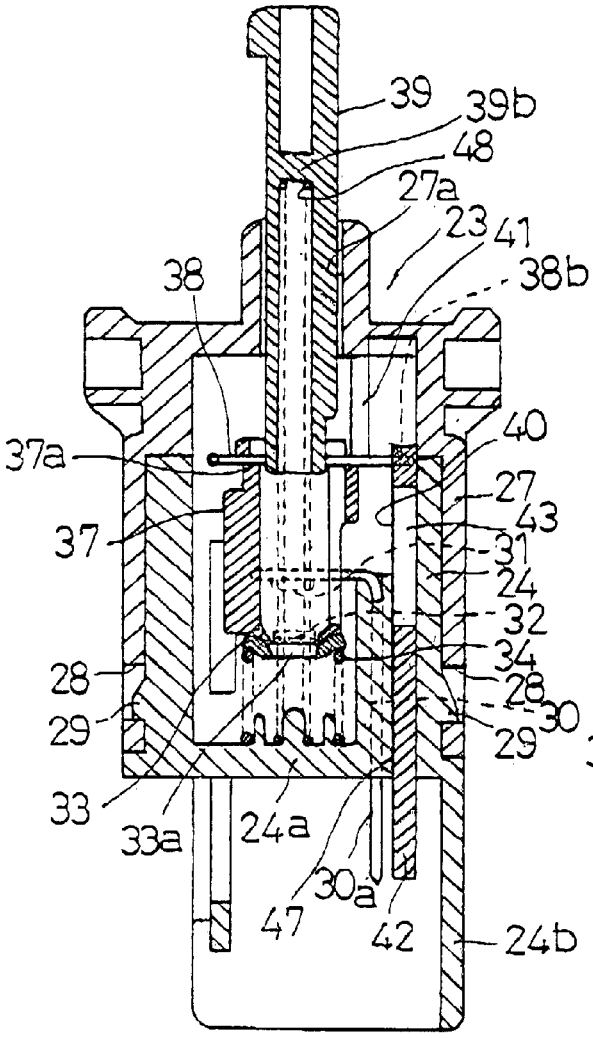
FIG. 1A is a sectional front view showing a stop lamp switch according to one embodiment of the present invention.
Figure 1B:
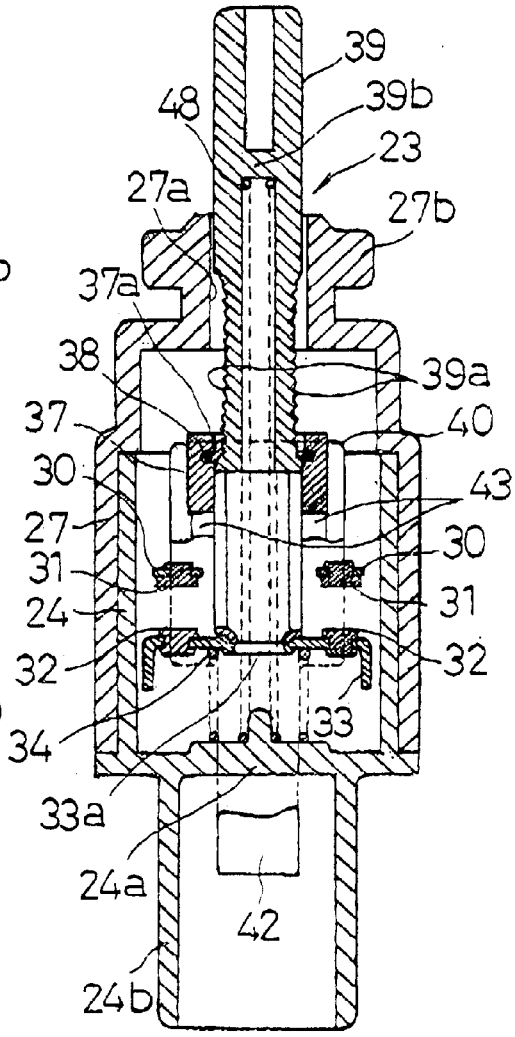
FIG. 1B is a sectional side view thereof.
Figure 2:
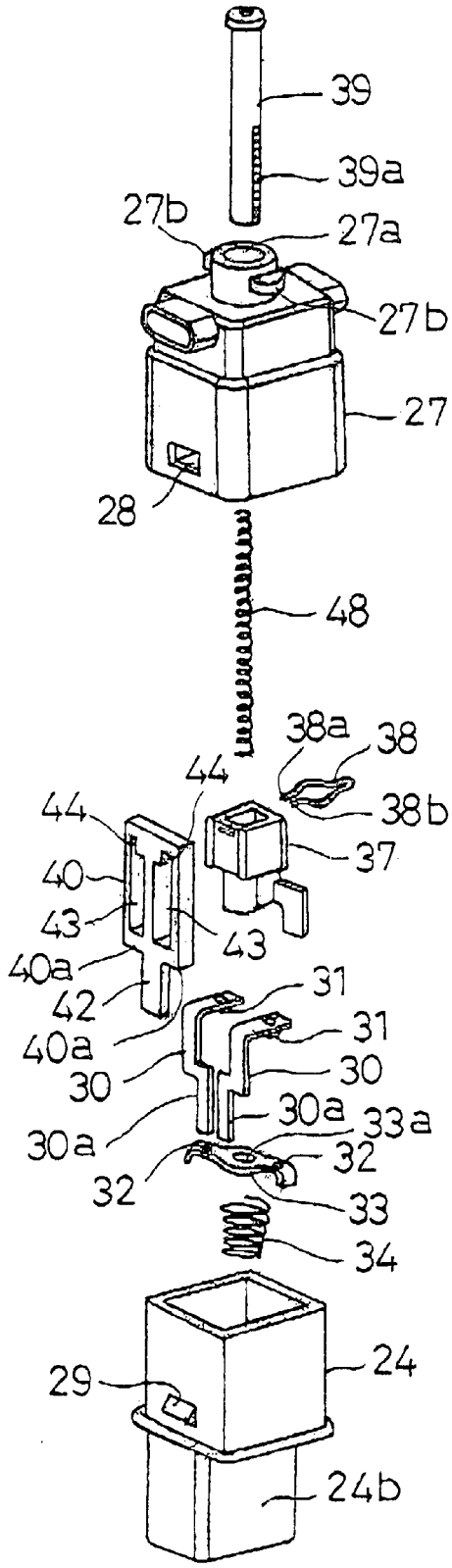
FIG. 2 is an exploded perspective view illustrating the stop lamp switch shown in FIGS. 1A and 1B.

Hereinafter, preferred embodiments of the present invention will be described in detail with reference to the accompanying drawings. FIG. 1A is a sectional front view showing a stop lamp switch 23 according to one embodiment of the present invention, FIG. 1B is a sectional side view thereof, and FIG. 2 is an exploded perspective view of the stop lamp switch 23. FIGS. 1A and 1B show the stop lamp switch 23 before its attachment to a vehicle. In this stop lamp switch 23, a cylindrical case 24 made of an insulating resin with an upper open end and a cover body 27 are integrally connected to each other by engaging engagement claws 29 of the case 24 with engagement holes 28 of the cover body 27, thereby constituting a container-like switch case body.

A connector connection part 24*b*, which serves to fit a connector described below thereto, is integrally formed with the case 24 below its bottom wall 24*a*. A pair of fixed contacts 31 are fixedly attached to respective bent end portions of terminal plates 30. The terminal plates 30 penetrate through the bottom wall 24*a* so that terminal portions 30*a* of the respective terminal plates 30 are projected into the connector connection part 24*b*, whereby the pair of fixed contacts 31 are held at predetermined positions within the case 24. A pair of movable contacts 32, which constitute switch contacts with the pair of fixed contact 31, are provided on both sides of a contact plate 33 having a through hole 33*a* in its middle portion. The movable contacts 32 are energized toward the fixed contacts 31 by a contact pressure spring 34 which is interposed between the contact plate 33 and the bottom wall 24*a* of the case 24 in a somewhat deflected state. Before attachment of the stop lamp switch 23 to a vehicle, the pair of movable contacts 32 are in elastic contact with one end (a lower end in FIGS. 1A and 1B) of an actuator 37 described below.

Figure 3:
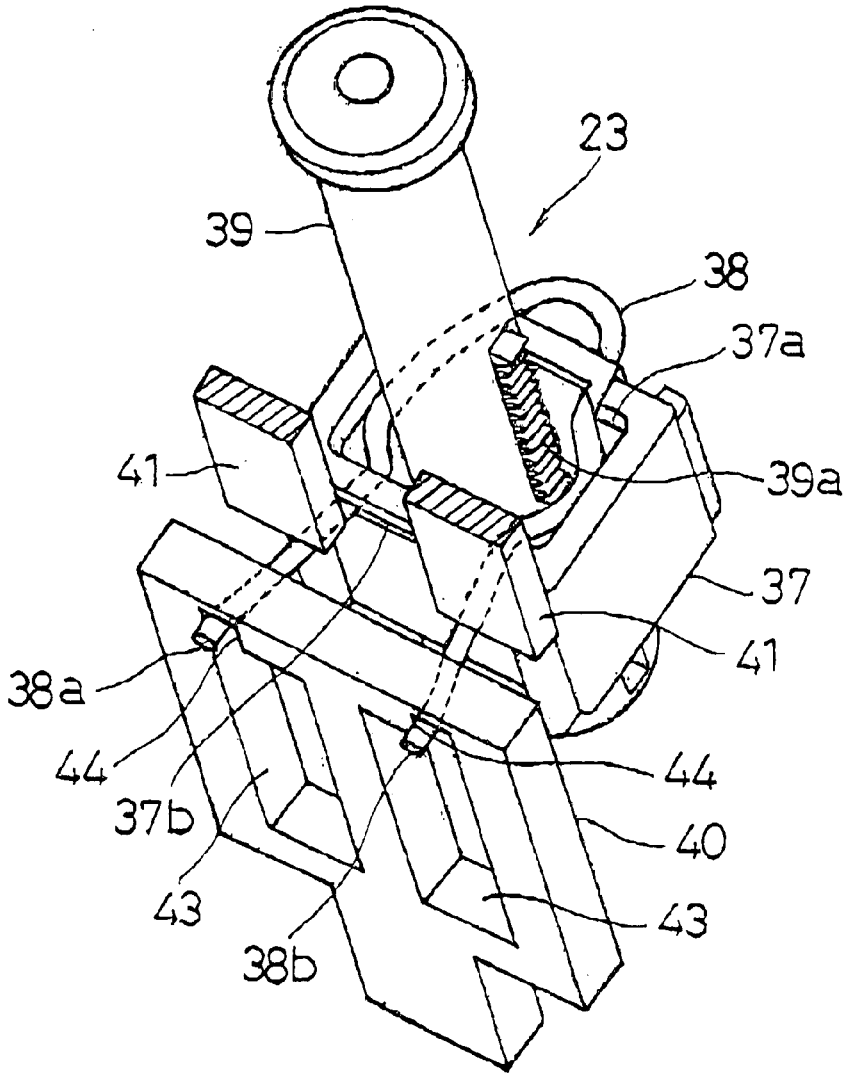
FIG. 3 is a perspective view illustrating a main part of the stop lamp switch shown in FIGS. 1A and 1B.

The cylindrical actuator 37 for bringing the movable contacts 32 into contact with the fixed contacts 31 and for separating the movable contacts 32 from the fixed contacts 31 is provided so as to be freely slidable in in/out directions with respect to the case 24 through fitting of a guide rib (not shown) provided on the actuator 37 itself to a guide groove (not shown) of the case 24. An engaging spring 38 having an approximately U shape when viewed from a plane is attached to the vicinity of the other end (an upper end in FIGS. 1A and 1B) of the actuator 37 through the engagement between them. More specifically, as shown in FIG. 3 which is a perspective view illustrating a main part of the above-described stop lamp switch 23, attachment grooves 37*a* and 37*b* are respectively formed in the vicinity of ends of two opposed walls of the rectangular cylindrical actuator 37. The engaging spring 38 is inserted through both the attachment grooves 37*a* and 37*b* to be attached to the actuator 37 by engagement therebetween so as to perpendicularly cross the open end of the actuator 37. Both free ends 38*a* and 38*b* of the engaging spring 38 are projected from one side of the actuator 37.

One end (a lower end in FIGS. 1A and 1B) of a cylindrical operating shaft 39 having a head is penetrated through a guide hole 27*a* of the cover body 27 to be connected to one end of the actuator 37 with the engaging spring 38 being interposed therebetween such that their relative position can be changed. More specifically, the operating shaft 39 has serrated concave-convex locking portions 39*a* along an axial direction on parts of its outer face, the parts of the outer face being opposed to each other in a radial direction. The operating shaft 39 is forced into a slightly enlarged middle space of the U-shaped engaging spring 38 while the concave-convex locking portions 39*a* are pushing the middle portion aside so as to spread it. As a result, the operating shaft 39 is connected to the actuator 37 through the engaging spring 38. At this moment, as clearly shown in FIGS. 1A and 1B, one end of the operating shaft 39 is connected to one end of the actuator 37 with the engaging spring 38, interposed therebetween. With such a structure, the operating shaft 39 is inserted into the actuator 37 so as to allow its projected length from the actuator 37, that is, a connected length between the operating shaft 39 and the actuator 37 to be adjusted.

This stop lamp switch 23 differs from the existing stop lamp switches in that a spring regulating member 40 for holding the pair of free ends 38*a* and 38*b* of the engaging spring 38 in a spread state and position regulating pieces 41 for regulating the position of the actuator 37, formed on an inner face of the cover body 27 in a protruding manner, are additionally provided. The spring regulating member 40 has, on its one end (on a lower end in the drawing), a protruding working piece 42 having a small width. The protruding working piece 42 is integrally formed with the spring regulating member 40 in a protruding manner. In addition, a pair of clearance holes 43 and engaging step portions 44 are formed in the spring regulating member 40. Each of the engaging step portions 44 is provided on one edge of the clearance hole 43 on its outer side (on the upper side in FIGS. 1A and 1B) of each of the clearance holes 43.

The pair of free ends 38*a* and 38*b* of the engaging spring 38 are respectively penetrated through the clearance holes 43 so as to be locked to the pair of engaging step portions 44 in an outwardly spread state. In this manner, the spring regulating member 40 holds the engaging spring 38 in a spread state. At this moment, the spread middle portion of the engaging spring 38 is in light contact with the concave-convex locking portions 39*a* of the operating shaft 39. Mere application of an extremely small force on the operating shaft 39 allows the insertion of the operating shaft 39 into the actuator 37 through the middle portion of the engaging spring 38. For better understanding of this state, FIG. 1B shows in an exaggerated manner a state where the middle portion of the engaging spring 38 is separated from the concave-convex locking portions 39*a*.

Then, the actuator 37 is pushed to be moved to the position where the movable contacts 32 are separated from the fixed contacts 31 by a predetermined distance while compressing the contact pressure spring 34. At this position, tips of the pair of position regulating pieces 41 are held while abutting on the engaging spring 38. For the spring regulating member 40 holding the above-described engaging spring 38 in a spread state, the protruding working piece 42 is penetrated through the through hole 47 of the case 24 to be inserted into the connector connection part 24*b* so as to hold a bottom face 40*a* of the spring regulating member 40 being placed on the bottom wall 24*a* of the case 24. The operating shaft 39 is energized in such a direction that the operation shaft 39 is projected from the guide hole 27*a* of the cover body 27 by a small spring pressure of a return spring 48. The return spring 48 is interposed in a slightly deflected state between an engaging wall portion 39*b* formed in a middle portion of the operating shaft 39 and the bottom wall 24*a* of the case 24. As described above, the operating shaft 39 is held at a relative position with respect to the actuator 37 where the engaging spring 38 is engaged with the concave-convex locking portions 39*a* with a small engagement force. Therefore, before attachment of this stop lamp switch 23, the movable contacts 32 are separated from the fixed contacts 31 so that the switch contacts are in an OFF state.

Figure 10:
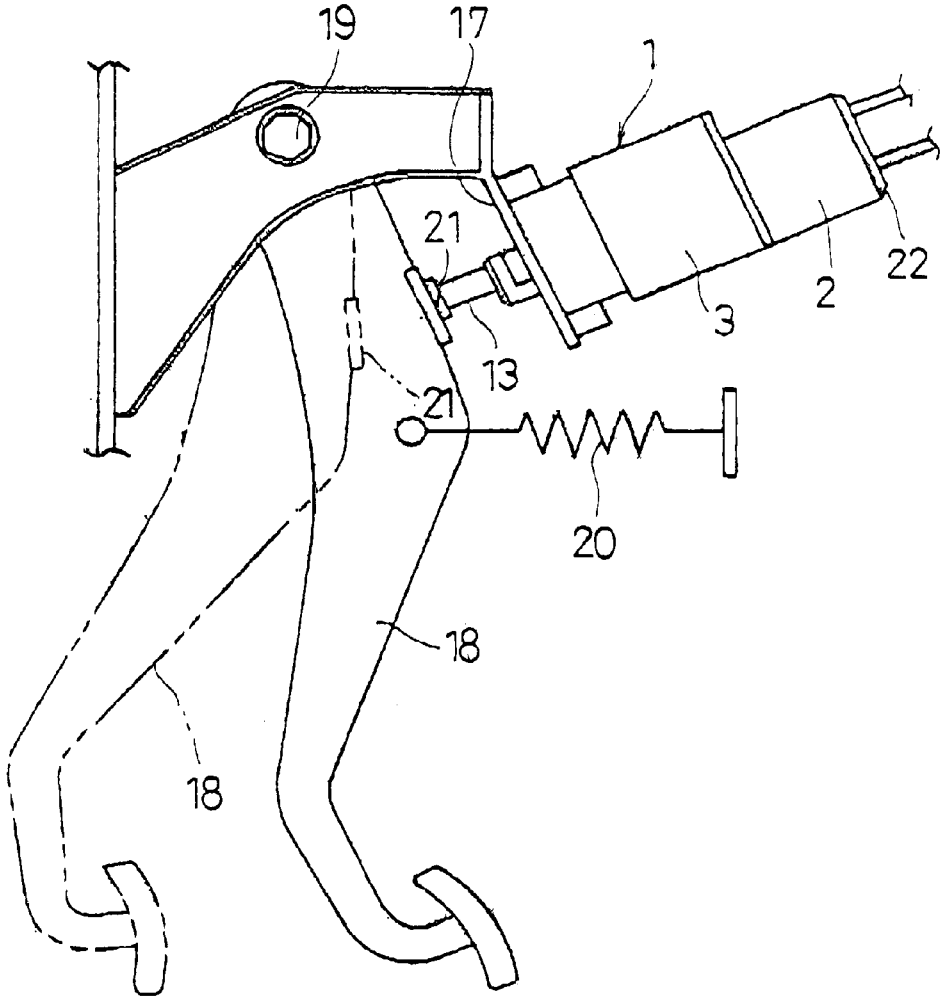
Fig. 10 Prior Art
FIG. 10 is a side view showing a state where the conventional stop lamp switch is attached to a vehicle.

Next, a procedure of attaching the above-described stop lamp switch 23 to a vehicle will be described with reference to FIGS. 4 to 8B. The same components as those in FIG. 10 are denoted by the same reference numerals in FIG. 4, whereas the same components as those in FIGS. 1A and 1B are denoted by the same reference numerals in FIG. 5A to FIG. 6B and FIGS. 8A and 8B, and the overlapping description thereof will be omitted in the following description.

Figure 4:
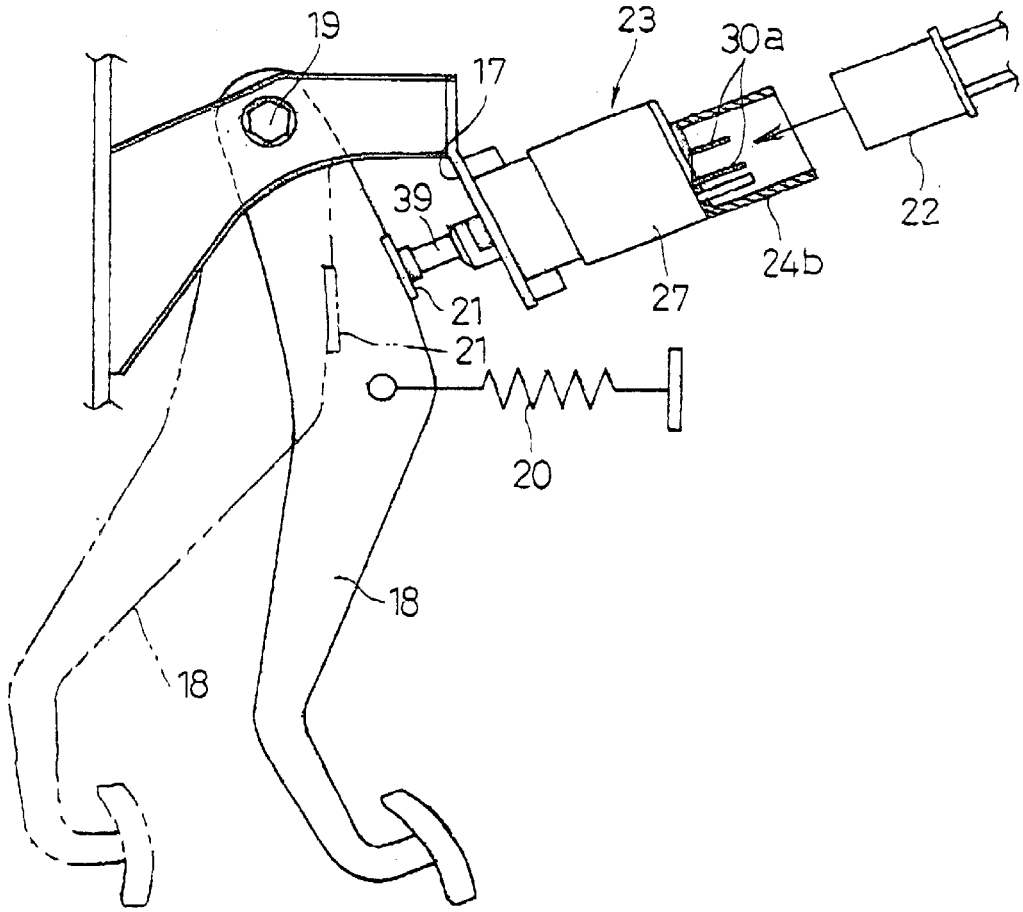
FIG. 4 is a side view showing a state where the stop lamp switch shown in FIGS. 1A and 1B is attached to a vehicle.
Figure 5A:
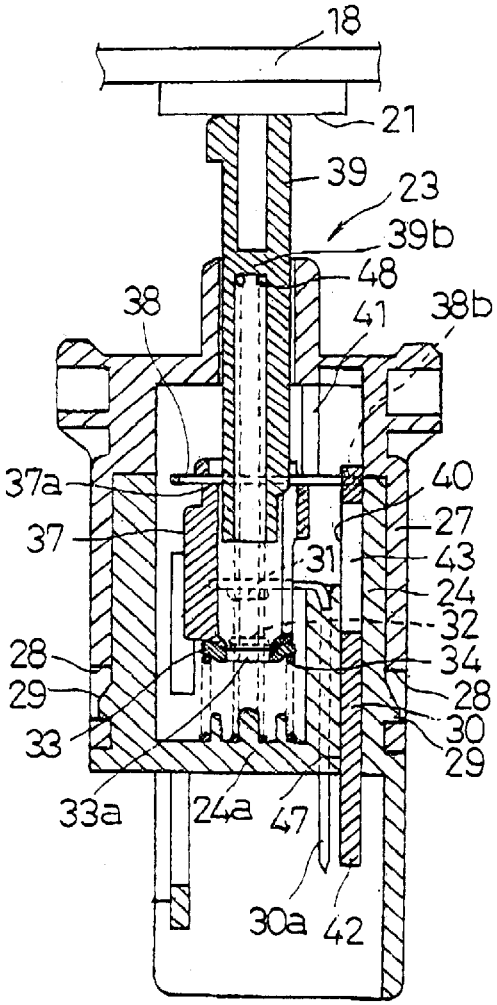
FIG. 5A is a sectional front view showing a state where a projected length of an operating shaft in the stop lamp switch is adjusted with respect to a brake pedal.
Figure 5B:
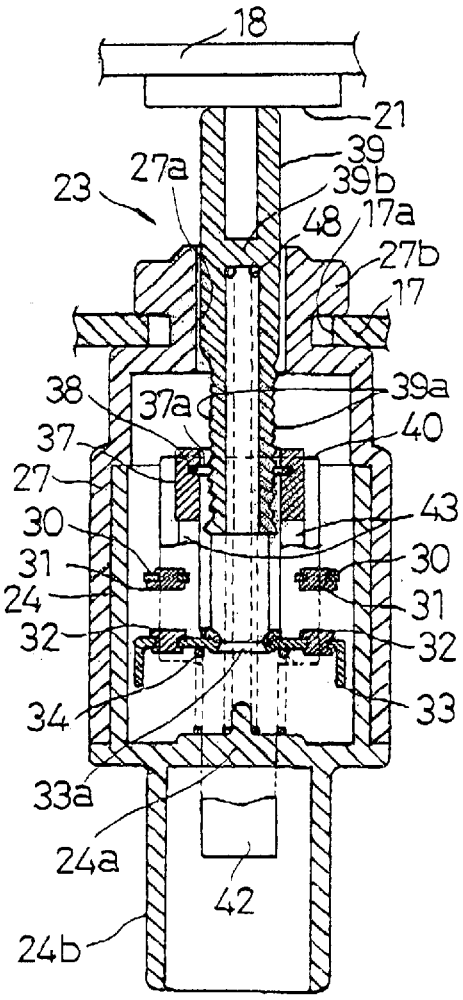
FIG. 5B is a sectional side view thereof.

First, as shown in FIG. 4, the operating shaft 39 of the stop lamp switch 23 is penetrated through the attachment hole 17*a* of the attachment bracket 17, so that a tip of the operating shaft 39 is pressed against the abutting face 21 of the brake pedal 18 at a normal position indicated with a solid line in FIG. 4. At this moment, the operating shaft 39 is held merely by the engaged state generated by a small engagement force between the concave-convex locking portions 39*a* and the engaging spring 38 in a spread state and the energizing force of the return spring 48. Therefore, the operating shaft 39 is subjected to a reaction to a pressure of the tip of the operating shaft 39 applied onto the abutting face 21 so as to be inserted into the actuator 37 while deflecting the return spring 48 in a compressed state as shown in FIGS. 5A and 5B. It is sufficient to apply an extremely small pressure to insert the operating shaft 39 into the actuator 37 as described above. Therefore, even if the brake pedal 18 is not held at the normal position indicated with the solid line shown in FIG. 4, the brake pedal 18 does not move from the normal position.

Then, when the operating shaft 39 is inserted into the actuator 37 to a predetermined position shown in FIGS. 5A and 5B, engaging portions 27*b* of the cover body 27 shown in FIG. 2 are penetrated through the attachment hole 17*a* of the attachment bracket 17. More specifically, this state signifies that the adjustment of a projected length of the operating shaft 39 from the actuator 37 is completed. In this state, the stop lamp switch 23 is relatively rotated, for example, at an angle of 90 degrees with respect to the attachment bracket 17. As a result, an edge of the attachment hole 17*a* of the attachment bracket 17 is fitted under a lower part of each of the engaging portions 27*b* of the cover body 27, thereby completing the attachment of the stop lamp switch 23 to the attachment bracket 17.

Figure 6A:
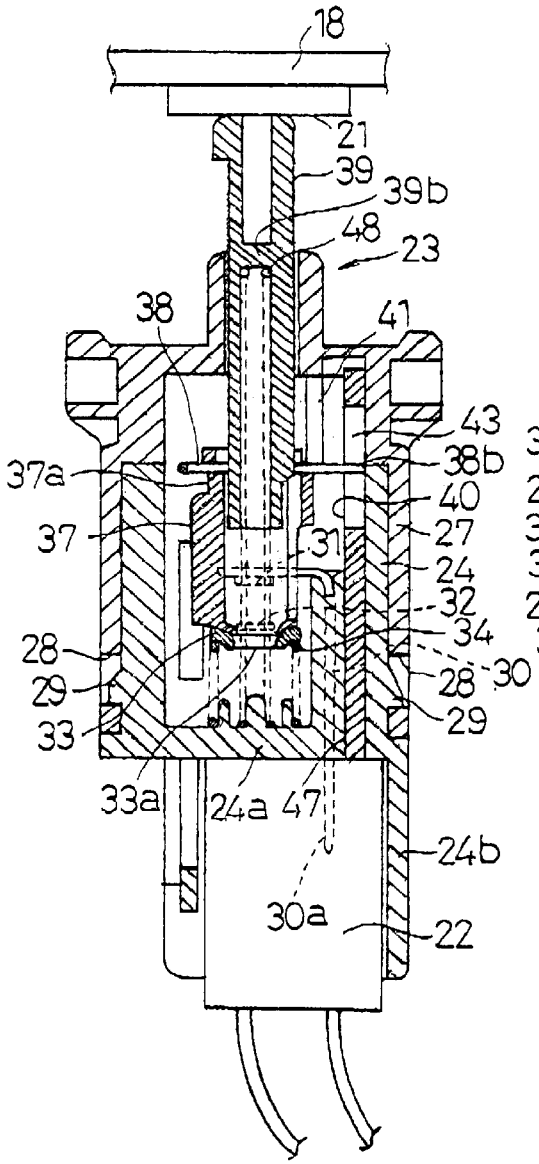
FIG. 6A is a sectional front view showing a state where a connector is fitted to the stop lamp switch shown in FIGS. 1A and 1B.
Figure 6B:
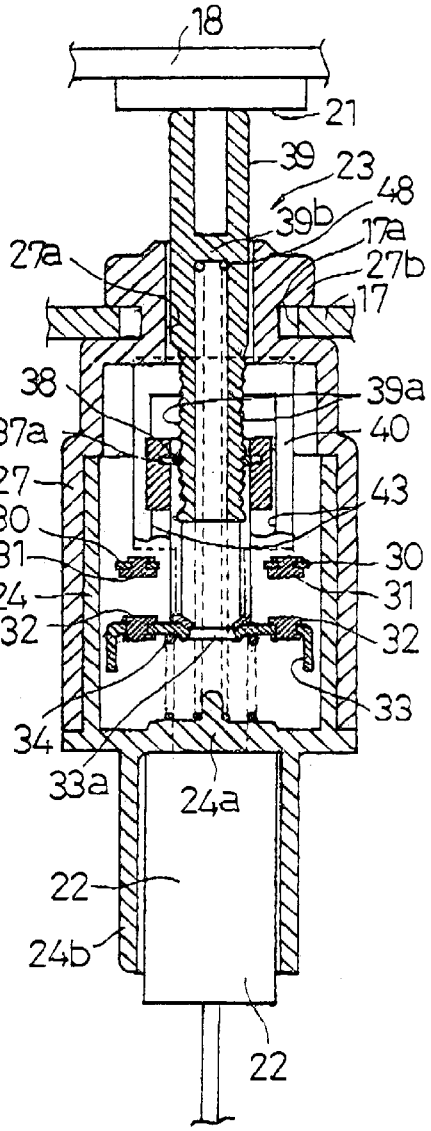
FIG. 6B is a sectional side view thereof.
Figure 7:
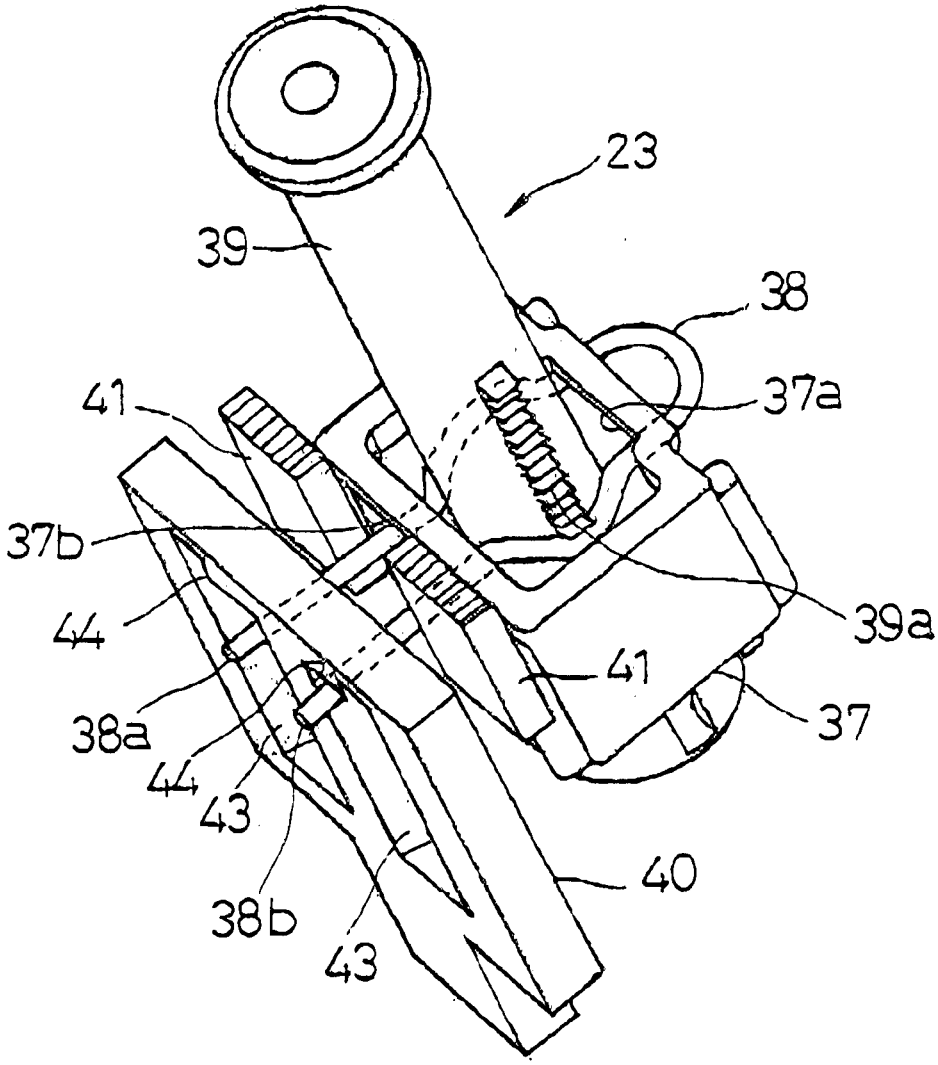
FIG. 7 is a perspective view showing a main part of the stop lamp switch in the state shown in FIGS. 6A and 6B.

When the attachment of the stop lamp switch 23 to the attachment bracket 17 is completed, the connector 22 is subsequently fitted to the connector connection part 24*b* of the case 24 as is indicated with an arrow in FIG. 4. As a result, the terminal portions 30*a* of the fixed contacts 31 provided on the terminal plate 30, which are projected from the bottom wall 24*a* of the case 24, are inserted to be connected to a power supply circuit of a stop lamp through the connector 22. At the same time, as shown in FIGS. 6A, 6B and 7, since the protruding working piece 42 of the spring regulating member 40 is pushed into the case 24 by the connector 22, the spring regulating member 40 is moved in a direction approaching the attachment bracket 17.

Accordingly, the pair of free ends 38*a* and 38*b* of the engaging spring 38 come out from the engaging step portions 44 of the spring regulating member 40 so as to come into the clearance holes 43, thereby canceling a spread state of the engaging spring 38. Therefore, the middle portion of the engaging spring 38 is pressed against the concave-convex locking portions 39*a* of the operating shaft 39 due to a restoring force generated by the cancellation of the spread state of the engaging spring 38. As a result, the operating shaft 39 is tightly connected to the actuator 37 with a projected length which has been adjusted to a predetermined relative position with respect to the brake pedal 18. Moreover, when the pair of free ends 38*a* and 38*b* of the engaging spring 38 return in an approaching direction due to the cancellation of the spread state of the engaging spring 38, the pair of free ends 38*a* and 38*b* come out from the position regulating pieces 41. As a result, the actuator 37 is allowed to arbitrarily move in in/out directions to/from the cover body 27, thereby completing the attachment of the stop lamp switch 23 to the attachment bracket 17 and the connection of the connector to the connector connection part of the case.

As is apparent from the above description, the stop lamp switch 23 can be attached to the attachment bracket 17 by only one operator. Moreover, since application of a large pressure is not required for the attachment, the attachment operation is facilitated to allow quick attachment of the stop lamp switch. In addition, the cancellation of a spread state of the engaging spring 38 and the cancellation of stopped movement of the actuator 37 are simultaneously effectuated when the connector 22 is fitted to the connector connection part 24*b* of the case 24. Consequently, the efficiency of the attachment operation is improved.

Figure 8A:
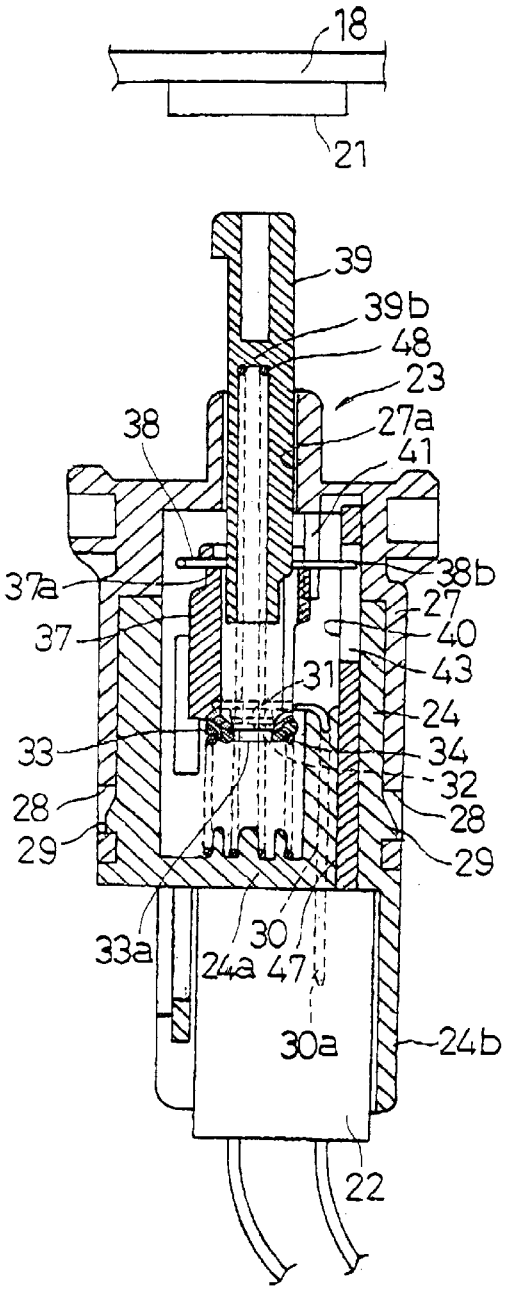
FIG. 8A is a sectional front view showing the stop lamp switch when the brake pedal is pressed.
Figure 8B:
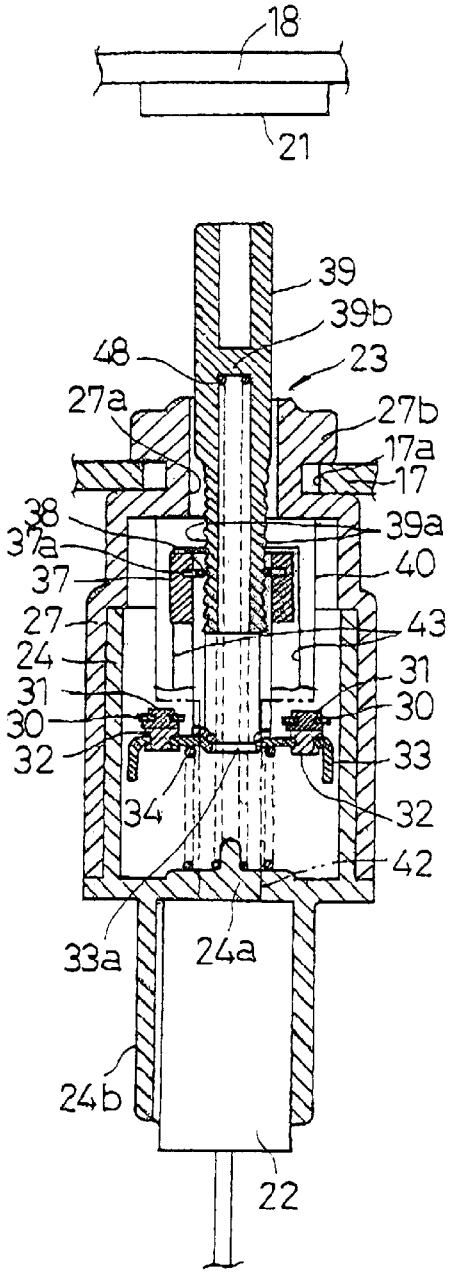
FIG. 8B is a sectional side view thereof.
Figure 9:
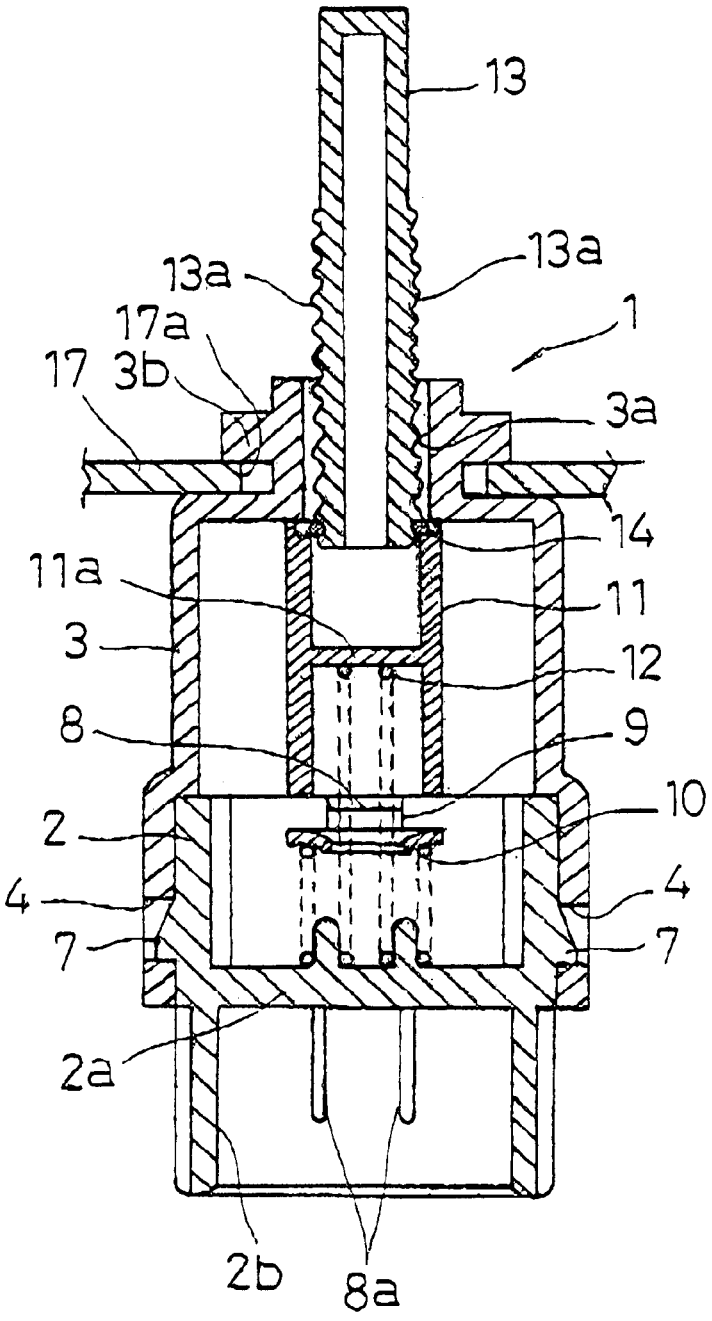
Fig. 9 Prior Art
FIG. 9 is a schematic longitudinal cross-sectional view showing a conventional stop lamp switch.

In the stop lamp switch 23 attached in the above-described manner, as shown in FIGS. 8A and 8B, when the brake pedal 18 is pressed, the operating shaft 39 moves in such a direction that the operation shaft 39 is projected from the cover body 27 due to an energizing force of the return spring 48 along with the separation of the abutting face 21 of the brake pedal 18 from the operating shaft 39. At the same time, the actuator 37 connected to the operating shaft 39 with the engaging spring 38 being interposed therebetween moves in an integral manner with the operating shaft 39 due to the energizing force of the contact pressure spring 34. Then, the movable contacts 32, which are pressed against the other end of the actuator 37 by the contact pressure spring 34, displace integrally with the actuator 37 so as to be brought into elastic contact with the fixed contacts 31 by the energizing force of the contact pressure spring 34. As a result, the switch contacts of the stop lamp switch 23 are brought into an ON state to light the stop lamp indicating that the pressing operation of the brake pedal 18 is effectuated.

As described above, according to the stop lamp switch of the present invention, the stop lamp switch can be attached to the attachment bracket by only one operator. Moreover, application of a large pressure is not required to adjust a projected length of the operating shaft for the attachment, the attachment operation is facilitated to allow quick attachment of the stop lamp switch.

Moreover, according to a method for attaching the stop lamp switch of the present invention, the connector is fitted to the connector connection part of the case, so that the cancellation of the spread state of the engaging spring and the cancellation of the stopped movement of the actuator are simultaneously and automatically effectuated. As a result, the efficiency of the attachment operation is improved.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. A stop lamp switch comprising:

a switch case body;

an operating shaft penetrating through a guide hole of the switch case body so as to be outwardly projected, an end of the operating shaft on an outer side abutting on a brake pedal of a vehicle;

a cylindrical actuator freely movably provided within the switch case body, for separating a movable contact from a fixed contact when the cylindrical actuator moves toward its one end along a core direction of its cylindrical body;

an approximately U-shaped engaging spring attached to the other end of the actuator so as to move integrally with the actuator, the engaging spring being engaged with a concave-convex locking portion provided on the other end side of the operating shaft so as to connect the other end of the actuator to the operating shaft; and a spring regulating member for spreading the engaging spring so as to engage both free ends of the engaging spring with engaging step portions provided to the spring regulating member in a freely engageable/disengageable manner with a reduced engagement force to the concave-convex locking portion, so that a protruding working piece provided to the spring regulating member is slidably penetrated through a through hole of a bottom wall of the switch case body to be outwardly projected, wherein after the operating shaft is inserted into the actuator so as to adjust a projected length of the operating shaft from the guide hole, the protruding working piece is pushed into the switch case body to move the spring regulating member so as to disengage both the free ends from the engaging step portions, whereby the engaging spring is engaged with the concave-convex locking portion so that the operating shaft is connected to the actuator in an integrally movable manner.

2. The stop lamp switch according to claim 1, wherein the switch case body is constituted by connecting a cylindrical case having an open end with a cover body covering the open end of the case;

the actuator is provided within the case so as to be freely movable in the core direction of the cylindrical case;

the operating shaft is penetrated through a guide hole of the cover body;

a terminal plate of the fixed contact is penetrated through the bottom wall of the case so that a terminal portion is guided into a connector connection part of the case; and the spring regulating member includes: a pair of clearance holes for allowing movement of both the free ends of the engaging spring upon integral movement of the operating shaft and the actuator in an outer direction along with separation of the brake pedal from the operating shaft caused by a pressing operation of the brake pedal; and the engaging step portions, each being formed on an edge of each of the clearance holes on its one end.

3. The stop lamp switch according to claim 2, wherein a contact pressure spring for energizing the movable contact toward the fixed contact is interposed between the movable contact and the bottom wall of the case, and a return spring for energizing the operating shaft in such a direction that the operating shaft is projected from the guide hole is provided between the operating shaft and the bottom wall; and the cover body has position regulating pieces respectively abutting on vicinities of both the free ends of the engaging spring so as to hold the actuator in a state where the movable contact is separated from the fixed contact due to movement of the actuator, each of the position regulating pieces being provided in a projected manner at a position allowing cancellation of abutment of the engaging spring simultaneously with disengagement of both the free ends from engaging portions of the spring regulating member.

4. A method for attaching the stop lamp switch according to claim 2, comprising:

penetrating the operating shaft of the stop lamp switch through an attachment hole of an attachment bracket opposing to the brake pedal of the vehicle so that a tip of the operating shaft abuts on the brake pedal;

pressing the stop lamp switch against the attachment bracket until an engaging portion of the operating shaft is penetrated through the attachment hole so as to push the other end of the operating shaft into the cylindrical actuator, thereby fixing the operating shaft to the attachment bracket; and simultaneously with fitting of a connector to the connector connection part of the stop lamp switch, pressing the protruding working piece of the spring regulating member with the connector so as to push the protruding working piece into the case.

* * * * *